United States Patent [19]

Bearup et al.

[11] 4,043,291

[45] Aug. 23, 1977

[54] ROWING AND STEERING DEVICE FOR BOATS

[75] Inventors: Charles D. Bearup, Phoenix, Ariz.; Marvin F. Few, Socorro, N. Mex.

[73] Assignee: Marvin F. Few, Socorro, N. Mex.

[21] Appl. No.: 651,134

[22] Filed: Jan. 21, 1976

[51] Int. Cl.[2] ..... B63H 1/32

[52] U.S. Cl. ..... 115/29; 416/83

[58] Field of Search ..... 115/28 R, 29, 30, 31, 115/32, 33; 416/72, 73, 74, 83

[56] References Cited

U.S. PATENT DOCUMENTS

| | | | |
|---|---|---|---|
| 2,507,469 | 5/1950 | Hanson | 115/29 |
| 2,808,802 | 10/1957 | Graham | 115/29 |
| 3,007,434 | 11/1971 | Laycox | 115/31 |

FOREIGN PATENT DOCUMENTS

| | | | |
|---|---|---|---|
| 239,964 | 9/1925 | United Kingdom | 115/29 |

*Primary Examiner*—Trygve M. Blix

*Assistant Examiner*—Charles E. Frankfort

*Attorney, Agent, or Firm*—Gregory J. Nelson

[57] ABSTRACT

A manually operable device for propelling and steering a boat is disclosed. A bracket is adapted to be secured to the stern of the boat. A bearing plate is rotatively mounted on the bracket and supports a tubular sleeve which is pivotal along an axis generally transverse to the longitudinal axis of the sleeve. An elongate vane or paddle shaft extends longitudinally through said tubular sleeve and is adjustable relative to the sleeve. The upper end of the shaft carries an arm adapted to be grasp by the boatman so that the shaft can be manually rocked or actuated. The lower end of the shaft carries one or more vanes which are swingable or pivotal between a motive position in one direction of actuation in which maximum surface area is presented to the water and a return position in the opposite direction of actuation in which there is minimum resistance to movement through the water.

2 Claims, 5 Drawing Figures

ROWING AND STEERING DEVICE FOR BOATS

The present invention relates to a rowing and steering device for boats. More particularly, the present invention relates to a combined rowing and steering device which can be mounted on a boat and manually manipulated to propel and steer the boat.

Manually operated propulsion devices for boats are well known. These devices generally comprise some type of oar or paddle which is clamped or affixed to the boat. The boatman manipulates or actuates the oar or paddle by use of his hands or feet propelling the boat in the desired direction. Some of these devices include rotating or oscillating propellers or screws. Other of these devices include vanes or paddles secured to a shaft member which can be pivoted to propel the boat. Many of these prior art devices, while effective, are difficult to operate or become difficult to operate over a period of use due to their complex mechanical nature and various bearing arrangements. For example, the prior art teaches use of a ball-type universal bearing for mounting the rowing shaft. Over prolonged use, the ball wears and the shaft can twist or turn in the boatman's hands if the boatman is not careful when operating the device.

Briefly, the present invention provides a combined rowing and steering device which can be mounted at the stern of a small boat and which is adapted for manipulation by the boatman with one or two hands. The device can be used as an emergency propulsion device in the case of engine failure or can be used as a device for propelling and steering of a boat quietly and in areas of minimum space. The device is particularly useful to fisherman and sportsman when trolling or maneuvering a boat into back water areas where space and obstructions do not permit use of conventional internal combustion or electric troll motors.

Briefly, the present invention relates to a boat propulsion device having a shaft carrying vanes or paddles at the lower end. The paddles assume a co-planar motive position when the shaft is actuated or reciprocated in one direction of operation and which move to a generally parallel position when the shaft is moved in the opposite direction of operation. The arm is pivotally and rotatively mounted in a bearing assembly which is carried on a clamp which can be secured to the stern of the boat. The arm is pivotal about a horizontal pivot shaft secured in bearing blocks carried on a circular bearing plate. The circular plate is rotatable in an annular groove formed in the bearing assembly. The paddle shaft may be longitudinally adjusted to submerge the paddles to the desired depth. The shaft may be rotated and reciprocated as required to steer and propel the boat.

The above and other objects of the present invention will become more apparent from the following description, claims and drawings in which:

Figure 1:
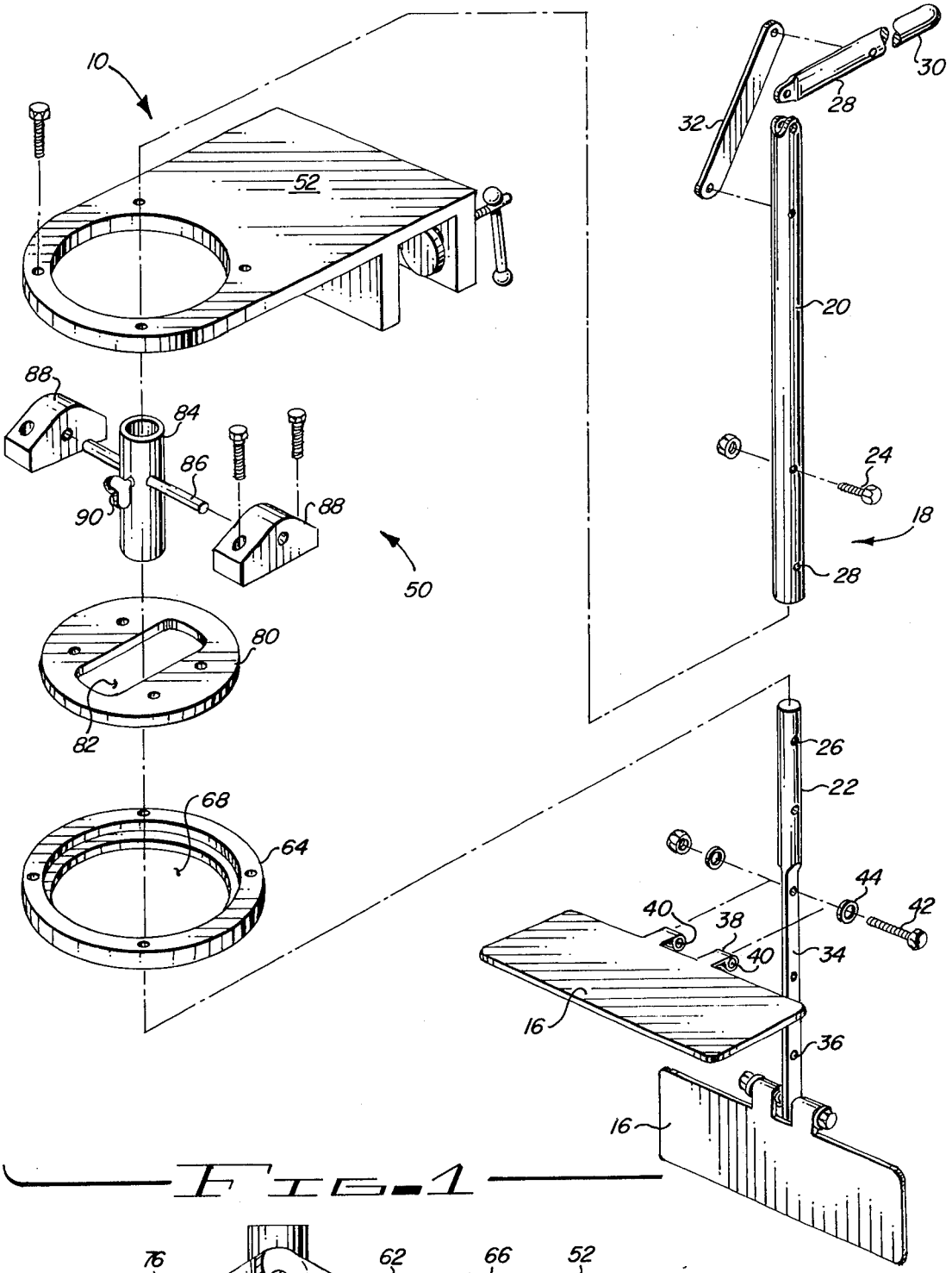
FIG. 1 is an exploded view showing the assembly of the device of the present invention.

Referring now to the drawings, the device of the present invention is generally designated by the numeral 10 and is adapted to be clamped to the transom 12 at the stern of a small boat 14. A plurality of paddles or vanes 16 are carried on the lower end of a shaft assembly 18. The shaft assembly 18 includes an upper tubular member 20 which receives a lower tubular member 22 in internal sliding engagement. The overall length of the tubular assembly 18 may be adjusted by sliding lower member 22 relative to upper member 20. The entire assembly is made rigid by extending bolt 24 through aligned holes 26 and 28 in tubular members 22 and 20, respectively.

The upper end of tubular member 20 carries an arm 28 which is angularly disposed relative to tubular member 20. The terminal end of the arm 28 carries a grip 30 which is adapted to be held by the operator. A brace 32 diagonally extends between arm 28 and tubular member 20 to make the entire assembly rigid. Brace 32 can preferably be disconnected from tube 20 so handle or arm 28 can be reversed when it is desired to "back" the boat.

Figure 3:
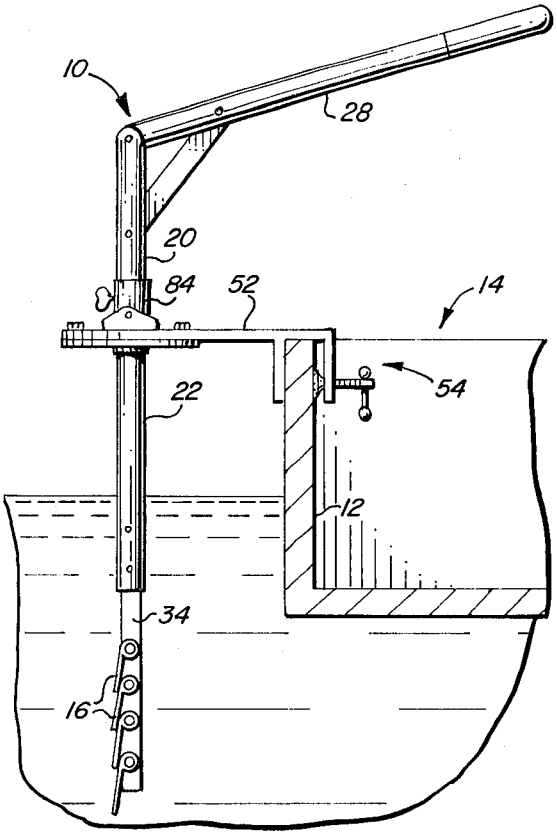
FIG. 3 is a side elevational view showing the device of the present invention attached to the stern of the boat.
Figure 4:
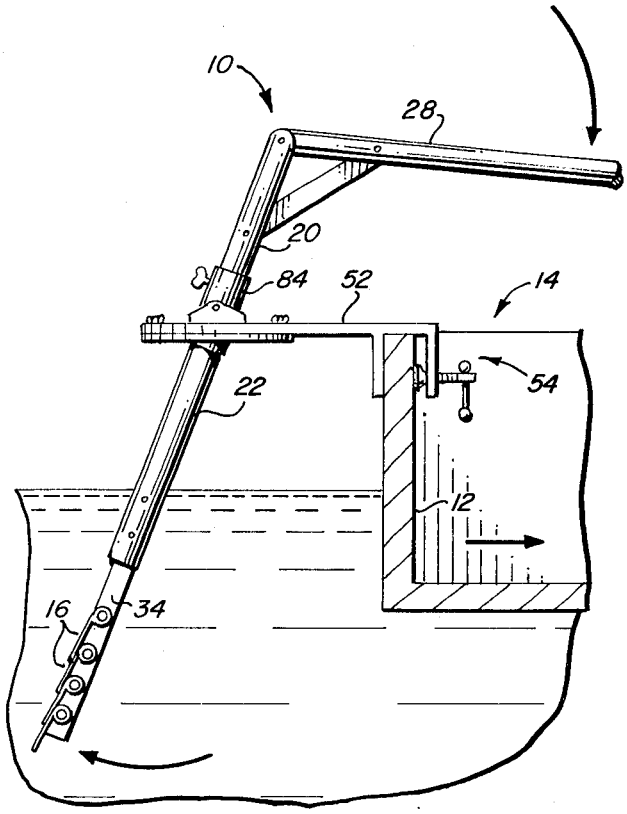
FIG. 4 is a side elevational view showing the device of the present invention being rearwardly actuated in a motive position to propel the boat in a forward direction.

The lower end of tubular member 22 is flatened to form a bar section 34 having a plurality of transverse holes 36 longitudinally spaced apart. One or more blades or vanes 16 are pivotally mounted on section 34 each vane having a pair of spaced apart tabs 38 projecting from the upper edge of the vane which oppositely align with holes 36. Each of the tabs 38 preferably includes a bushing or insert 40 of material such as that sold under the name "Teflon" or other low friction bearing material. An appropriate fastener 42 and washers 44 secure the vane 16 to the tubular member 22 so that the vanes are pivotal or swingable relative to shaft assembly 18. It will be appreciated that the individual vanes are positioned on member 34 relative to one another so that in a closed, generally vertical position, they are slightly overlapping as seen in FIGS. 3 and 4. In this position the vanes are in a mobile position and act against the water to propel the boat forwardly in the direction of the arrow as seen in FIG. 4. The individual vanes 16 are pivotal or swingable to a position generally perpendicular to the axis of tubular section 22 in an "open" position so that the resistance to movement of the device in water is minimized as the device is oppositely reciprocated. A more complete description of operation of the device follows.

Figure 2:
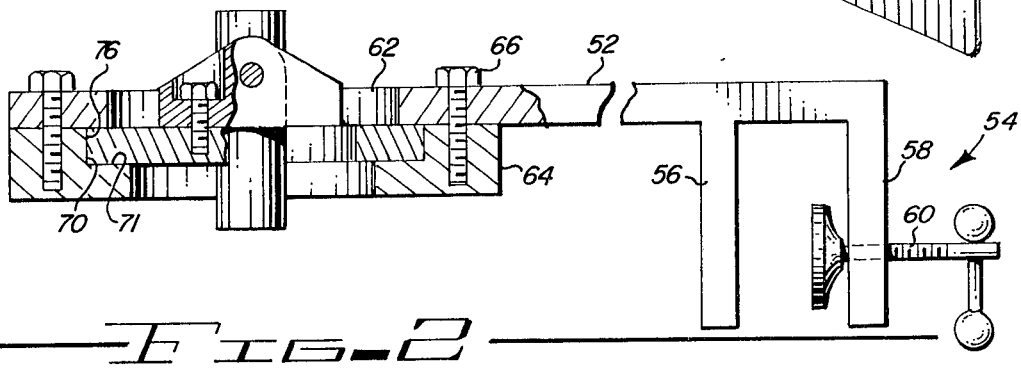
FIG. 2 is a detail view, partly in section, of the bearing and clamp assembly.

The device of the present invention is generally pivotal or reciprocable generally between the positions shown in FIGS. 3 and 4 and is also rotatable about the longitudinal axis of shaft 18. The pivotal motion and rotational motion is accomplished by means of a swivel assembly generally designated by the numeral 50 and is best seen in FIGS. 1 and 2. The swivel assembly 50 is carried on a cantilever arm 52 secured to clamp assembly 54. Clamp assembly 54 includes depending flanges 56 and 58 which are adapted to be engaged over the transom of the boat. A threaded clamping screw 60 can be advanced relative to flange 58 to tightly secure the device to the boat.

A circular opening 62 is provided in the outer end of arm 52. Collar 64 is secured to the underside of arm 52 by cap screws 66. Collar 64 defines an opening 68 which is concentrically aligned with the opening 62. An annular groove 70 extends interiorly of collar 64 defining bearing surfaces 74 and 76. Circular bearing plate 80 is rotative relative to collar 64 and arm 54 in groove 70. Bearing plate 80 is provided with an elongated opening or slot 82. A sleeve 84 extends through opening 82 in plate 80. Sleeve 84 carries a pair of transversely extending rods 86. Rods 86 are each received in bearing blocks 88 which are secured to bearing plate 80 at opposite sides of slot 82. It will be obvious that sleeve 84 can be pivoted or swung within slot 82. Tubular member 20 of the paddle assembly is received within sleeve 84. An appropriate set screw 90 secures tubular member 20 within sleeve 84. The large bearing area provided by bearing plate 80 makes directional steering of the device smooth and requires little effort. Propelling the boat is facilitated by the relative position of the rotational and pivot axes of the device.

In operation the device 10 of the present invention is secured to the transom 12 of a boat 14 by positioning depending flanges 56 and 58 along either side of the boat's transom. Clamping screw 60 is turned down until the device is secured in place. Set screw 90 is loosened and shaft assembly 18 is vertically moved until the vanes 16 are submerged at an appropriate level. The vertical adjustment of shaft assembly 18 relative to sleeve 84 permits the boatman to adjust the device for use on boats having various free board heights. This adjustment also permits the user to position the handle as best suited to the physical size of the individual boatman. It will also be obvious that this adjustment will allow the vanes to be appropriately submerged in relation to the available water depth and conditions.

Figure 5:
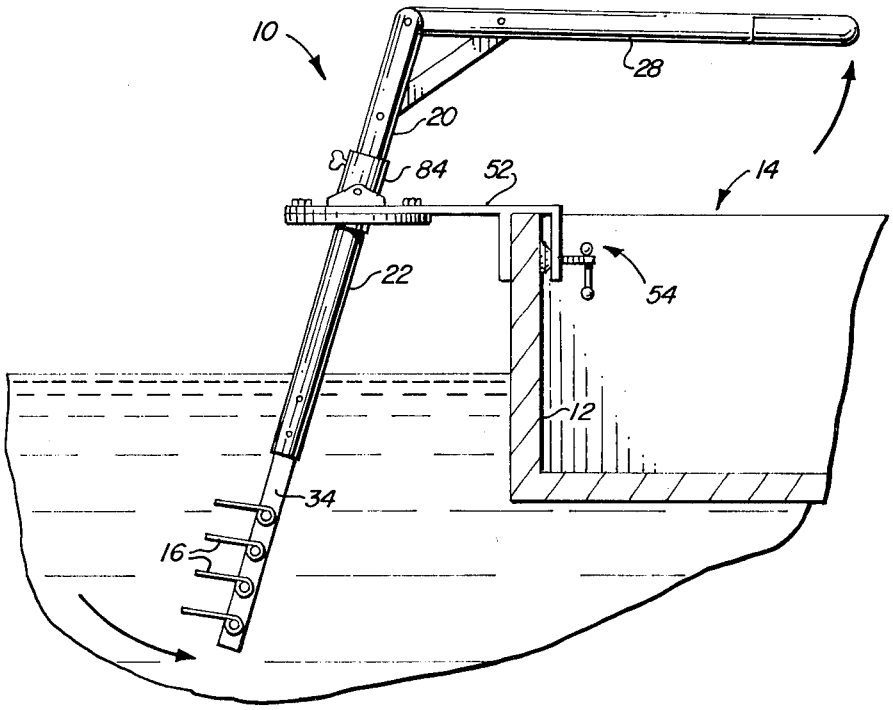
FIG. 5 is a view similar to FIG. 4 showing the device in a forwardly actuated position with the vanes or paddles open.

In order to propel the boat forwardly in a motive mode of operation, the user grasps the handle or grip 30 on arm 28 and applies a downward force as indicated in FIG. 4. The downward force will cause the device to pivot rearwardly about the pivot rods 86. As the device pivots rearwardly, the vanes or paddles 16 will be in the overlapping, closed position. As the paddles or vanes move rearwardly through the water, the reaction or the force of the water against the vanes will propel the boat in a forward direction. When the paddle shaft assembly has reached the rearward limit of its travel, the boatman applies an upward manual force on grip 30. This causes the paddle assembly to move forwardly causing the vanes to "open" as seen in FIG. 5. With the vanes in the open position, water can pass between the vanes and the resistance to movement of the submerged portion of the paddle assembly through the water is minimized. This operation is repeated so the boat is continuously propelled. This device is particularly useful to fisherman as the handle can be only intermittently actuated to maintain the boat in the desired position for fishing. Further, the main assembly is quiet and results in minimum water disturbance so there is little or no interference to fishing. The device can be raised to minimum submergence for use in shallow water.

Steering can easily be accomplished by rotating the paddle shaft assembly to any position on its axis so that the propelling force can be generated in a desired direction. For example, if it is desired to direct the boat or propel the boat to the starboard, the user will rotate the handle in a port direction the desired number of degrees. The entire swivel assembly and bearing plate 80 rotate easily along the bearing surfaces provided. The user then actuates the handle back and forth in the continuous rocking motion propelling the boar forward in the new desired direction of travel.

It is also possible to back the boat in the water by rotating shaft 18 so the faces of the vanes 16 are next adjacent the transom of the boat. Handle or arm 28 is reversed by disconnected brace 32 from tube 20 and pivoting to a new position now extending toward the boat. Brace 32 is reconnected to tube 20 and reciprocating of arm 28 will now impart rearward or backing motion to the boat.

The device of the present invention can be easily manufactured and is extremely reliable and durable. The device can be made from a wide variety of materials and should be relatively light and compact for convenience of transportation and storage. For storage, bracket or brace 32 can be removed and actuating arm 28 folded downwardly along tubular member 20.

It will be apparent from the foregoing that the present device is extremely versatile and convenient to operate. It will be obvious to those skilled in the art to make various changes, alterations and modifications to the device chosen for purposes of illustration. To the extent that these changes, alterations and modifications do not depart from the spirit and scope of the appended claims, they are intended to be encompassed therein.

I claim:

1. A combination manual propulsion and steering device for a boat which comprises:

a. a bracket adapted to be attached to a boat, said bracket having a generally horizontal rearwardly extending flange, said flange defining an opening;

b. a collar secured to said flange, said collar defining an opening therein substantially concentric with the opening in said flange, an annular groove extending around said collar;

c. a bearing plate rotatively secured between said flange and said collar at said annular groove, said bearing plate having a slot therein;

d. a sleeve pivotally carried on a pivot shaft having an axis generally transverse of the axis of said sleeve, said pivot shaft mounted in bearing members on said bearing plate;

d. a vane shaft assembly longitudinally extending through said sleeve;

f. means for releasably securing said vane shaft assembly relative to said sleeve;

g. a vane carried on the lower end of said vane shaft assembly pivotal relative to said vane shaft assembly between a motive and a non-motive position; and h. arm means located at the upper end of said vane shaft assembly for actuating the vane shaft whereby a boatman can propel said boat by manually reciprocating said arm means and whereby said boat can be steered by rotation of said vane shaft assembly and said bearing plate to position said vane relative to the boat to generate a force component in the desired direction.

2. The device of claim 1 including a plurality of vanes each pivotally carried on a shaft generally transverse of said vane shaft assembly wherein said vanes overlap one another in said motive position and pivot outwardly at substantial right angles to said vane shaft assembly in the reverse non-motive position.

* * * * *